US006926277B2

(12) United States Patent
Auricchio

(10) Patent No.: US 6,926,277 B2
(45) Date of Patent: Aug. 9, 2005

(54) SIMPLIFIED SINGLE THROW CRAPS GAME

(76) Inventor: Vincenzo Auricchio, 4620 Jason Ave., Great Neck, NY (US) 11028

( * ) Notice: Subject to any disclaimer, the term of this patent is extended or adjusted under 35 U.S.C. 154(b) by 0 days.

(21) Appl. No.: 10/749,054

(22) Filed: Dec. 30, 2003

(65) Prior Publication Data

US 2005/0140089 A1 Jun. 30, 2005

(51) Int. Cl.[7] ..... A63F 3/00

(52) U.S. Cl. ..... 273/274; 273/309

(58) Field of Search ..... 273/274, 146, 273/309

(56) References Cited

U.S. PATENT DOCUMENTS

| | | | | |
|---|---|---|---|---|
| 2,577,087 | A * | 12/1951 | Meeks | 273/145 D |
| 4,921,249 | A * | 5/1990 | Kropkowski et al. | 273/256 |
| 5,487,547 | A | 1/1996 | Hobert | 273/274 |
| 5,490,670 | A | 2/1996 | Hobert | 273/138 A |
| 5,775,696 | A | 7/1998 | Sidlow et al. | 273/274 |
| 5,782,002 | A | 7/1998 | Reed | 463/17 |
| 5,785,596 | A | 7/1998 | Hobert | 463/22 |
| 5,788,240 | A * | 8/1998 | Feinberg | 273/274 |
| 5,829,749 | A | 11/1998 | Hobert | 273/274 |
| 5,966,539 | A | 10/1999 | Srivastava | |
| 6,431,546 | B1 | 8/2002 | Keller | 273/274 |
| 6,464,225 | B1 | 10/2002 | Webb | 273/274 |
| 6,484,188 | B1 | 11/2002 | Kwong et al. | |
| 2004/0155401 | A1 * | 8/2004 | Oliva | 273/146 |

OTHER PUBLICATIONS

"Easy Craps-Rules", Bernie Stevens & Associates, http://www.berniestevens.com/rules_easy_craps.html, copyright 2001.*

United Kingdom Search from related application GB 0322323.7 dated Mar. 11, 2004.

* cited by examiner

*Primary Examiner*—Benjamin Layno
(74) *Attorney, Agent, or Firm*—Thomas J. Schab

(57) ABSTRACT

A simplified version of traditional casino style craps is provided where all bets are determined through a single roll of the dice, thus making the game easily understood by novice gamblers. The layout of the game includes a primary, second and third wagering areas. The primary wagering area provides an even money payout through two possible betting lines, an Under Seven line and an Over Seven line, based on the sum total of the roll of the dice in relation to the most probable roll of a seven. The primary wagering area also includes a non-betting line of Seven-You Lose All Bets, that clears all bets when a seven is rolled, even those bets placed within any of the other wagering areas. The second wagering area also includes two betting lines, one that predicts that the sum total of the dice will be a three and the other that the total will be an eleven. The betting lines of the second wagering area payout at 10 times the wager. The third wagering area has six betting lines, and each line represents the shooter rolling one of the possible combinations of doubles. The third wagering area has a payout for each betting line that is 25 times the wager. The only betting restriction of the game concerns who may become the shooter, which is chosen from only those players that bet within the primary wagering area. A successive shooter is the next clockwise player who is immediately adjacent the previous shooter and one who has placed a wager in the primary wagering area.

10 Claims, 2 Drawing Sheets

SIMPLIFIED SINGLE THROW CRAPS GAME

BACKGROUND OF THE INVENTION

1. Field of the Invention

The present invention relates to a method and apparatus for playing a dice game, and more particularly to a craps gaming arrangement that simplifies the traditional casino style craps game with uncomplicated rules and payout schemes, thereby appealing to less-experienced gamblers.

2. Discussion of the Prior Art

Many states other than Nevada and New Jersey now offer legalized gambling on either Indian reservations or riverboats. Thus, it can be appreciated that wherever the gaming establishment is located, the competition is fierce among casinos and the like in attracting new and continued patrons to their particular gaming establishments.

For example, casinos in Las Vegas have redirected their marketing energies to attract families as possible new patrons through a variety of sideshow attractions such as battling pirate ships and roller coasters that dive through the casino. Other casinos have marketed new patrons through their provision of specialized slot machines promising six-figure jackpots or million dollar gaming tournaments. However, not all casinos across the nation have the means to compete in terms of such theme layouts or exotic payouts. Given the nature of the casino business, it would be advantageous for all casinos to experience a continuous increase in new gaming patrons without the need to spend millions of dollars on magnificent building structures, or grandiose promotions and jackpot payouts. To this extent, it would be advantageous for a casino to maximize the number of patrons and the dollars wagered at each gaming apparatus disposed within the casino. Although the slot machine is probably the most popular gaming device at a casino due to its simplicity, its play is relatively slow-paced, as players usually take their time in wagering their allotted money as a means of extending their playing time before losing their money. Furthermore, slot machines can only accommodate one wagering player at a time, thus limiting the number of dollars played at one gaming device.

Craps on the other hand, is a well-known and popular game that generates the most excitement and energy within the casino, often drawing the largest crowds with the most vocal gamblers. The allure or fascination with craps is that it is a fast-paced game which provides a player the best house odds in hitting a large payout. However, as popular as craps is, the game itself is often complicated and intimidating to inexperienced players because of the relatively large number of betting areas, the types of bets that may be placed, as well as the complexity of the craps table layouts. Although it is financially advantageous to the casino that craps tables do not limit the number of players per table and/or roll of the dice, craps is a labor-intensive game requiring at least three or four trained staffers at each table.

Heretofore, the ability to retain the aura and excitement of traditional craps while appealing to a wide variety of patrons, i.e., young, old, experienced or novice, has been highly limited. Ideally, it would be desirable to provide a new type of dice game that incorporates advantageous features of a traditional casino craps game while providing a simple layout and payout scheme in order to encourage novices to play. Additionally, it would be advantageous to the casino to provide a new type of dice game that encourages a continuous, multiplicity of patrons to place simultaneous wagers.

SUMMARY OF THE INVENTION

It is a principal object of the present invention to mix the one-roll concept of roulette with a dice game by providing a simplified version of traditional casino style craps. The object is met by providing a dice game that can be played by a single player or by a multiplicity of players, and which comprises a marked playing surface and a pair of dice having six surfaces with indicia thereon for uniquely identifying each of the faces. The marked playing surface has a primary wagering area comprising two betting lines, wherein the first betting line is an Under Seven line and the second betting line is an Over Seven line. The primary wagering area also includes a third line known as a Seven-You Lose line, which will be explained in greater detail later herein. The playing surface also includes a second and a third wagering area, whereby the second wagering area comprises a pair of betting lines, with the first betting line represents indicia on the dice sum totaling a three, while the second betting line represents indicia on the dice sum totaling an eleven. The playing surface further includes a third wagering area that comprises six betting lines, each respective betting line representing identical indicia on the dice or doubles.

In another aspect of the invention, it is intended to provide a method of playing the dice game of the invention, wherein the method comprises a first step of receiving wagers from the plurality of players in the primary wagering area that one of two outcomes will occur with respect to the sum total of the dice in comparison to rolling a sum total of seven. Then, a shooter of the dice is determined from a random selection of all the wagering players who placed a bet in the primary wagering area. Next, and independent of the wagering that occurred in the primary wagering area, optional wagers may be received from those players wagering in a second and third wagering area, wherein in order for the actual shooter of the dice to wager in the second and third wagering areas, he must have first placed a wager in the primary wagering area. Once all wagers are placed across the board and a shooter is established, the shooter rolls the pair of dice wherein the sum total appearing on the dice resolves the payouts of all wagers placed within the primary, second and third wagering areas. If a seven is rolled, all bets are lost to the house. If a sum total under seven is rolled, then only those who wagered in the primary area on the Under Seven betting line will be considered winners, wherein they will be paid even money, as well as an additional payout according to the payout schemes listed in the second and third wagering areas if the winners placed a bet within those areas. Likewise, if a sum total over seven is rolled, then only those players who wagered in the primary area on the Over Seven betting line will be considered winners and paid even money, as well as any additional payouts according to the payout schemes listed in the second and third wagering areas if those winners placed a bet within the second and third wagering areas. Finally, as a means to promote more participation as an actual shooter of the dice, once the designated shooter loses within the primary wagering area, the next player who is clockwise to the losing shooter will become the next shooter of the dice, provided that he of course, first wagers in the primary wagering area. If he does not wager in the primary wagering area, the dice will be passed to the player who is clockwise to him, and so on.

The features and advantages of the invention will be further understood upon consideration of the following detailed description of an embodiment of the invention taken in conjunction with the drawings, in which:

DETAILED DESCRIPTION OF A PREFERRED EMBODIMENT

Figure 1:
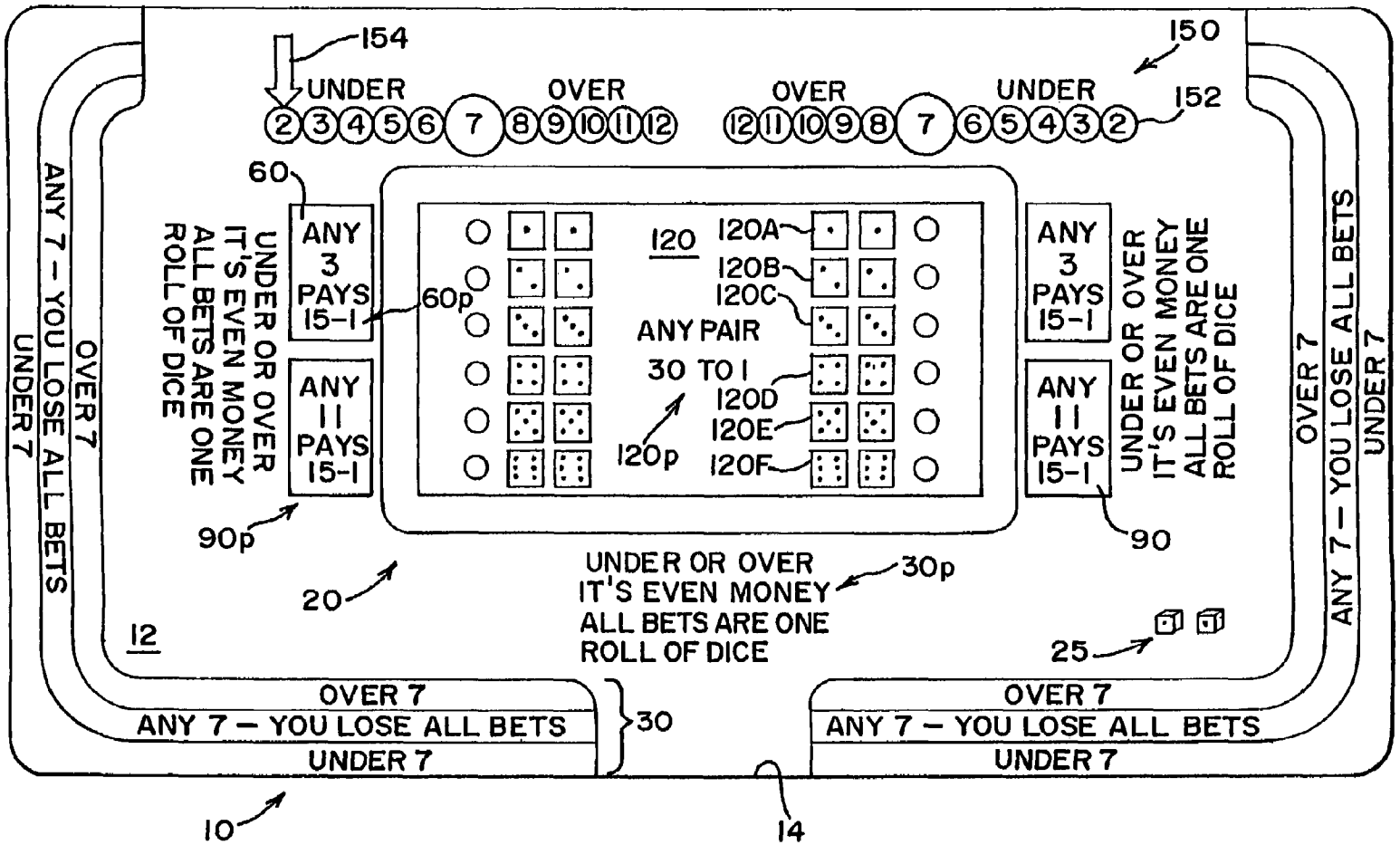
FIG. 1 is a plan view of a table arrangement according to the preferred embodiment of the present invention.

Referring to FIG. 1, the simplified game of craps according to the present invention is played on a conventional casino craps gaming structure 10 that includes a planar table surface 12 and a continuous peripherential sidewall 14 that circumscribes surface 12. The layout 20 is printed by known methods on planar surface 12 and is seen to include the following: a plurality of wagering areas 30, 60, 90, 120 that represent a variety of wagers that are associated with different dice combinations; payoff information 30*p*, 60*p*, 90*p*, 120*p* within each of the wagering areas; and a display area 150. A wagering player within the primary wagering area 30 may be designated as the shooter, and he rolls two dice 25 simultaneously in order to determine the win/lose outcome of all wagers placed on the simplified craps layout 20. The roll of the dice occurs on planar surface 12 and they must hit against sidewall 14 at either end of the planar surface 12 before coming to rest. Of course, it is a requirement that should one of the dice fail to remain on gaming surface 12, the shooter must roll the dice over again. The outcome of the roll of the dice 25 is based upon the sum total of the indicia on the two sides of the dice that face up after the dice come to rest. The sum total of the dice is compared to the possible wagering outcomes listed on layout 20 to determine if a payout is to be made. With the present invention, simplification has resulted in changing the "pass" and "no-pass" wagering areas of a traditional casino craps gaming layout to a primary wagering area 30 having two betting lines named UNDER SEVEN and OVER SEVEN; a non-betting area labeled ROLL A SEVEN-YOU LOSE, also appears in the primary wagering area and that area controls whether any payouts will be made across the board. As noted in FIG. 1, the primary wagering area 30 extends peripherentially about surface 12 similar to the "pass" line of traditional craps, except for the areas where the stick man, the dealer, and his helpers stand. The UNDER SEVEN wager is a prediction that the sum total of the roll of the dice will result in a value that is less than seven, while the OVER SEVEN wager is a prediction that the sum total will be greater than seven. As an alternative embodiment, the UNDER/OVER SEVEN wagers may respectively relate to whether the sum total of the dice is an odd or even number, rather than a sum total in relation to seven. The payoff information 30*p* indicates that any winning wager placed in this area will be paid even money, while a roll of a seven will clear all wagers off the entire gaming surface. The primary wagering area 30 differs significantly from the "pass" and "don't pass" lines of traditional casino craps in that the outcome of all wagers are determined by a single roll of the dice. That aspect is unlike traditional casino craps where many of the wagers remain active on the table until "craps" is finally rolled.

It is preferable to require a bet on either the UNDER SEVEN or OVER SEVEN betting lines to enable a player to be considered as a potential shooter of the dice. Thus, the only entrance requirement of the present invention relates to who may be considered as the shooter. A player who does not want to be considered as a potential shooter may still place a bet within one of the wagering areas 60, 90 or 120 without betting the come out line of the primary wagering area 30. This simple change in the come out line also makes it readily apparent to even a novice player that the outcome of all wagers will be dependent upon the sum total of the dice relative to the number seven, whereby when a seven is rolled, all bets placed on the table are lost. In contrast, traditional craps requires at least a minimal knowledge of the game to know when a "pass" or "no-pass" situation presents itself, and most novice players do not understand that aspect of the game by mere observation. Furthermore, this simple change in the come out line forces shooters to be changed more frequently and more quickly, adding to the attraction of the game since everyone wagering desires to eventually become the shooter.

The layout 20 is also seen to include the secondary wagering areas 60 and 90 at each lateral end thereof, which are comprised of two discrete betting lines that are respectively provided with a description of the type of wager and the payoff 60*p* or 90*p*. For betting area 60, the wager is that a player is predicting the sum total of the dice to be a three, and the payoff information 60*p* indicates that for a winning wager, or a sum total of the dice resulting with a three, a payoff of 10 times the amount of all chips wagered will be made to those players in area 60. For betting area 90, the wager is related to the sum total of the dice resulting with an eleven, whereby the payoff information 90*p* indicates that the payoff is 10 times the amount of all chips wagered by all individuals in area 90. FIG. 1 further shows that layout 20 includes a third wagering area 120 that is arranged with images of six dice combinations, or six betting lines 120A–F, that are comprised of doubles of the indicia printed on each of the faces of the dice 25. As payout information 120*p* indicates, whenever the roll of the dice results with doubles of one of the indicia printed on the dice, a preferable payoff of 25 times the amount of all chips wagered by a player will result for a winning wager. For example, if a double one combination is rolled, (betting line 120A) the payoff amount will be 25 times the dollar value or number of chips wagered. Likewise, the other betting lines 120B–F, will also pay out the same 25-1 amount. It is anticipated that the house of the establishment which incorporates the present invention will ultimately decide minimum and maximum values of all wagers placed within each of the wagering areas 30, 60, 90 and 120.

FIG. 1 also shows that layout 20 preferably includes the visual display area 150 immediately adjacent the wagering areas for informing the players and observers of the rolled outcome of dice 25 with respect to the come out line of primary wagering area 30. The various sum totals that may appear on the dice are also printed as numbered indicia 152 on the layout 20, within display area 150. As mentioned earlier, the come out line of primary wagering area 30 of the present invention is predicated upon the sum total of the dice relative to rolling a seven. Therefore, it is seen that the number seven is predominantly displayed in comparison to the other possible sum total values since a roll resulting with a seven will clear all wagers off the playing surface 20. It is also seen that the numbered sum total indicia 152 are separated according to their relationship with respect to the predicted outcomes of the come out line, i.e., a sum total that is either under or over seven. It is also seen that there are two sets of indicia 152 at each lateral end of layout 20. In this way, the dealer's helpers can readily display the rolled outcome on each end of the table layout in order to accommodate all gaming players. It is preferable that display area 150 further includes a respective and identical marker 154 for each set of indicia 152 that comprises a round black and white striped marker "doughnut" that is manually moved by the dealer's helpers after each successive roll of the dice. The helper at each lateral end of layout 20 will place the doughnut 154 directly on top of the indicia number 152 that resulted from the roll of the dice, thereby avoiding confusion as to what resultant sum total number was rolled. It should be clear that the markers 154 will be moved after each roll of the dice since the present invention is a one-roll dice game. The markers that are used on the "pass" line of traditional casino style craps on the other hand, will remain in place on a shooter's come out number until he rolls craps, which may be a plurality of rolls.

Alternatively, an electronic arrangement may be substituted for the manual marker display, where each sum total number (2–12) in the form of indicia 152 further includes an associated lighted, visual means (not shown) that is actuatable between two states, ON or OFF. Whenever the shooter rolls the dice 25, the outcome of his roll appears on the indicia 152 by turning that indicia to the ON state when that number has been met. The indicia 152 may be light bulbs (not shown) with the sums of numbers appearing on the bulbs themselves or the indicia may comprise numbers painted on the layout 20 with the light bulbs located immediately above or below the numbers. Alternatively, the display area 150 may even comprise a combination mechanical/electrical arrangement where a repositionable or sliding marker 156 would be used to indicate the results of the roll of the dice, whereby the marker 156 horizontally moves and stops above whatever numbered indicia 152 the rolled outcome represents. As shown here, the marker 156 is positioned above the number two, indicating that the shooter rolled a sum total of two. The arrowed marker would then automatically travel and stop above the numbered indicia 152 that represents the next succeeding roll of the dice, and so on. It is preferable that the display area 150 be associated with playing surface 12, although it is possible to located display area 150 on the side wall 14, or to form the display area 150 as a separate member that is not directly connected with the layout 20, such as locating the display area 150 on a pole or wall mounted panel member.

Play of the game of the present invention proceeds as follows. All players who wish to be considered the shooter must place a bet within the primary wagering area. Once placed, the dealer will initially choose who will become the first shooter. Optional wagers in the second and third wagering areas are simultaneously placed and the shooter may also bet these areas. The shooter then rolls the dice 25 and the sum total is displayed on the display area 150, as described immediately above. The unique and distinguishing feature of the present invention is that the fate of all of the wagers will be determined by a single roll of the dice. This means that all bets will be lost to the house if a seven is rolled or they will be paid according to the stated payout schemes listed on layout 20. If a sum total of seven is not rolled, then successful bets in the primary wagering area 30 will be paid even money, while those in the second wagering areas 60,90, will be paid 10-1, and those in the third wagering area 120 will be paid 25-1. Thus, it can be appreciated that the game of the present invention is exciting and fast-paced, yet very simple to play and understand. A player who is initially designated as the shooter will remain in that position until he rolls a seven or does not win his bet on the come out line (Under Seven/Over Seven) in wagering area 30, at which time the dice are returned to the dealer. A new shooter will then be chosen and it is preferable that the next shooter will be the player who is immediately clockwise with respect to the shooter who just lost his bet. The next clockwise player will become the next shooter as long as he wagers in the primary wagering area 30.

Figure 2:
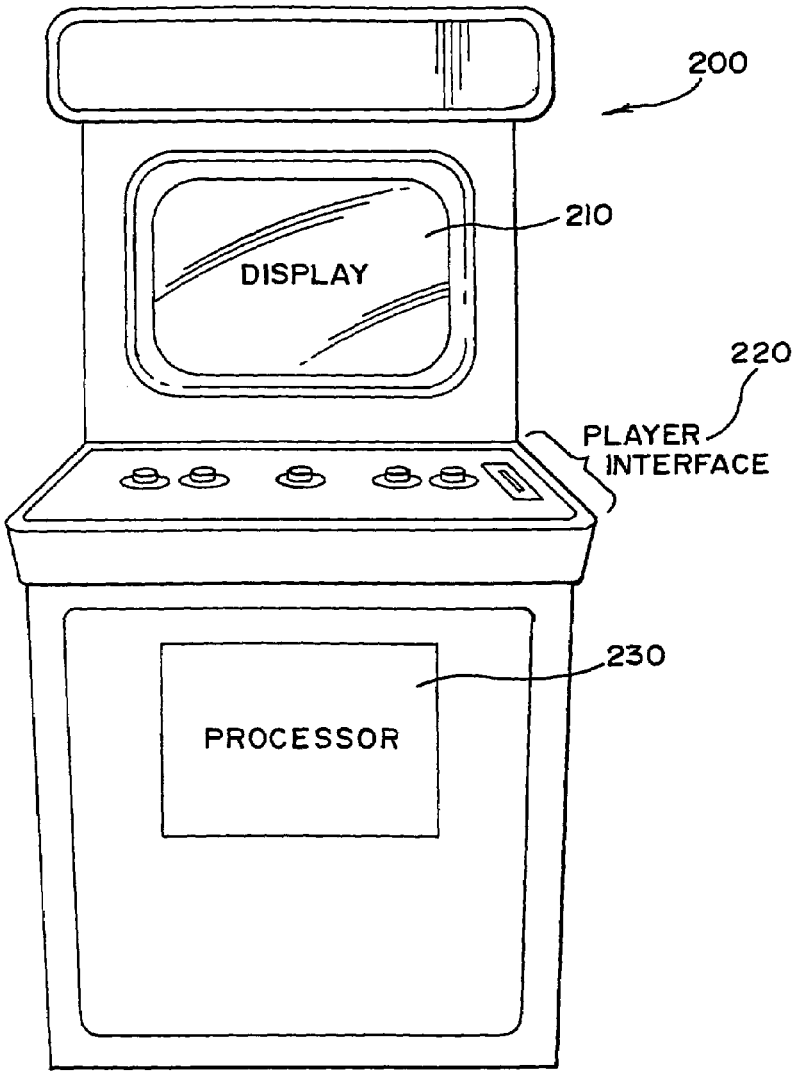
FIG. 2 is a schematic diagram illustrating the structure effecting game play according the apparatus of the present invention.

As would be apparent to those skilled in the art, the present invention may be embodied in a wide variety of forms and electronic media, including, but not limited to video machines, stationery and hand-held electronic games and devices, lottery terminals, internet entertainment websites, CD's and floppy disks. In addition, it is envisioned that the present invention can be readily implemented as a computer program product comprising a computer readable medium having control logic recorded therein to implement the features of the invention as described above. The control logic would be loaded within the CPU of the computer, which would then perform all operations necessary to execute the features of the invention such as the selection an amounts of bets within each wagering area, the selection of the shooter, the rolling of the dice, payout functions, etc. In this context, FIG. 2 shows a schematic arrangement of all the components of an apparatus 200 configured as immediately described above for playing the simplified craps game of the invention. The apparatus 200 includes a visual display means 210, a player interface board 220, and accompanying circuitry 230 such as a CPU for executing the features of game play as described. The apparatus 200 may be arranged for only a single player or it may be designed to allow a discrete number of players, say for instance, but not limited to four players.

With the methodology according to the present invention, a one-roll version of casino style craps is provided, where gamblers are enticed to play a simple game that is readily understood by even novice players. While the methods and apparatus herein disclosed form a preferred embodiment of this invention, it will be understood that this invention is not so limited, and changes can be made without departing from the scope and spirit of this invention, which is defined in the appended claims.

I claim:

1. A method of playing a dice game using a pair of dice and involving at least one player, the method comprising the steps of:

receiving from said players, a plurality of wagers placed in a primary wagering area that one of two events will occur;

establishing a shooter of the dice based upon a random selection of all wagering players who wagered in said primary wagering area;

receiving an optional second and third wager placed in a respective second and a third wagering area that a plurality of events will occur, wherein the second and third wagers placed by the shooter are dependent upon him placing a wager in the primary wagering area;

rolling the pair of dice by the shooter;

resolving the primary, secondary and third wagers based on the sum total of the roll of the dice, wherein when the sum total of the dice is a seven, all wagers in the primary, second, and third wagering area are lost and cleared.

2. The method of claim 1, wherein the primary wagering area represents a wager that an indicia on each of the rolled dice will result with a sum total that is one of under seven and over seven.

3. The method of claim 2, wherein when the sum total of the dice is under seven, all players that wagered accordingly will be paid a like amount as their respective wager and all players that wagered differently will lose their respective wagers, and wherein the shooter is retained as long as he wagered accordingly.

4. The method of claim 2, wherein when the sum total of the dice is over seven, all players that wagered accordingly will be paid a like amount as their respective wager and all players that wagered differently will lose their respective wagers, and wherein the shooter is retained as long as he wagered accordingly.

5. The method of claim 1, wherein the second wagering area represents a wager that an indicia on each of the rolled dice will result with a sum total that is one of a three and an eleven.

6. The method of claim 5, wherein when the sum total of the dice is one of a three and an eleven, all players that wagered accordingly will be paid a return that is 10 times the amount of any wager placed within the second wagering area.

7. The method of claim 1, wherein the third wagering area represents a wager that the rolled dice will each result with a same indicia, thereby producing a doubles of that combination.

8. The method of claim 7, wherein when the sum total of the dice is a double of each indicia on the dice, all players that wagered accordingly will be paid a return that is 25 times the amount of any wager placed within the third wagering area.

9. The method of claim 1, further including the step of receiving from said players a plurality of successive wagers that are placed in the primary wagering area and that a successive shooter is randomly selected.

10. The method of claim 1, wherein a next shooter of the dice is the first player who placed a wager in the primary wagering area and who is located immediately clockwise to the previous shooter.

* * * * *